US010170260B2

(12) United States Patent
Hayashida et al.

(10) Patent No.: US 10,170,260 B2
(45) Date of Patent: Jan. 1, 2019

(54) ELECTROMAGNETIC RELAY

(71) Applicant: OMRON Corporation, Kyoto-shi, Kyoto (JP)

(72) Inventors: Yasuo Hayashida, Kumamoto (JP); Ayaka Miyake, Kikuchi (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/509,865

(22) PCT Filed: Oct. 28, 2015

(86) PCT No.: PCT/JP2015/080390
§ 371 (c)(1),
(2) Date: Mar. 9, 2017

(87) PCT Pub. No.: WO2016/088485
PCT Pub. Date: Jun. 9, 2016

(65) Prior Publication Data
US 2017/0309429 A1 Oct. 26, 2017

(30) Foreign Application Priority Data
Dec. 5, 2014 (JP) ..... 2014-247348

(51) Int. Cl.
*H01H 9/30* (2006.01)
*H01H 50/02* (2006.01)
(Continued)

(52) U.S. Cl.
CPC ..... *H01H 50/02* (2013.01); *H01H 50/026* (2013.01); *H01H 50/54* (2013.01);
(Continued)

(58) Field of Classification Search
CPC ..... H01H 50/02; H01H 50/38; H01H 50/54; H01H 2205/002
(Continued)

(56) References Cited

U.S. PATENT DOCUMENTS 2,725,488 A 11/1955 Hueffed et al.
3,103,563 A 9/1963 Grenier
(Continued)

FOREIGN PATENT DOCUMENTS

CN 101388303 A 3/2009
CN 201311887 Y 9/2009
(Continued)

OTHER PUBLICATIONS

The Japanese Office Action dated May 29, 2018 in a counterpart Japanese application.
(Continued)

*Primary Examiner* — Shawki S Ismail
*Assistant Examiner* — Lisa N Homza
(74) *Attorney, Agent, or Firm* — Metrolexis Law Group, PLLC

(57) ABSTRACT

An electromagnetic relay includes a base, an electromagnet block having a spool with a through hole opening at a flange portion thereof and mounted on an upper surface of the base, a movable iron piece, a movable contact piece rotatable integrally with the movable iron piece, a movable contact fixed to a free end of the movable contact piece, and a fixed contact fixed to a fixed contact terminal and contactable with and separable from the movable contact along with rotation of the movable contact piece. Insulating ribs project from an inward facing surface of a spacer integrally formed with the movable iron piece and an outward facing surface of the flange portion respectively such that the insulating ribs intercept a straight line connecting a magnetic pole portion projecting through the through hole and the fixed contact or the fixed contact terminal with a shortest distance.

8 Claims, 17 Drawing Sheets

(51) Int. Cl.
*H01H 50/54* (2006.01)
*H01H 50/38* (2006.01)
*H01H 50/60* (2006.01)

(52) U.S. Cl.
CPC ..... *H01H 50/38* (2013.01); *H01H 50/60* (2013.01); *H01H 2205/002* (2013.01)

(58) Field of Classification Search
USPC ..... 335/201
See application file for complete search history.

(56) References Cited

U.S. PATENT DOCUMENTS 3,364,450 A 1/1968 Conner
3,388,353 A 6/1968 Isler
3,441,800 A 4/1969 Lee
3,518,589 A * 6/1970 Koehler ..... H01H 50/04 335/132
3,544,929 A 12/1970 Di Marco et al.
3,688,230 A 8/1972 Tichy
3,745,492 A 7/1973 Grunert
3,942,144 A 3/1976 Contal
4,068,200 A 1/1978 Krueger
4,129,843 A 12/1978 Keller et al.
4,259,652 A 3/1981 Mattson
4,266,105 A 5/1981 Perkins, Jr.
4,307,361 A 12/1981 Grunert et al.
4,367,448 A * 1/1983 Nishizako ..... H01H 9/443 218/26
4,401,863 A 8/1983 Lemmer et al.
4,404,443 A * 9/1983 Coynel ..... H01H 1/62 218/23
4,475,094 A 10/1984 Grenier et al.
4,484,165 A 11/1984 Grenier et al.
4,529,953 A 7/1985 Myers
4,590,449 A 5/1986 VanTielen
4,631,507 A 12/1986 Guery et al.
4,644,308 A 2/1987 Guery et al.
4,688,011 A 8/1987 Lemmer et al.
4,713,636 A 12/1987 Lemmer et al.
4,808,952 A 2/1989 Berner et al.
4,931,757 A 6/1990 Lemmer et al.
4,973,929 A 11/1990 Duchemin
5,109,146 A 4/1992 Maenishi
5,119,053 A 6/1992 Mostosi
5,256,992 A 10/1993 Fasola et al.
5,293,521 A 3/1994 Blanchard et al.
5,500,630 A 3/1996 Edwards, Jr. et al.
5,502,426 A 3/1996 Blanchard et al.
5,517,167 A 5/1996 Yamamoto et al.
5,638,038 A 6/1997 Suzuki et al.
5,684,442 A 11/1997 Hufschmid
5,867,081 A 2/1999 Arnoux et al.
5,986,529 A 11/1999 Miyata et al.
6,116,558 A * 9/2000 Yano ..... H01R 12/7011 248/27.3
6,911,884 B2 6/2005 Uotome et al.
6,956,728 B2 10/2005 Zhou et al.
7,098,763 B2 8/2006 Larcher
7,760,055 B2 7/2010 Adunka et al.
7,852,178 B2 12/2010 Bush et al.
7,859,373 B2 12/2010 Yamamoto et al.
7,915,985 B2 * 3/2011 Schmitz ..... H01H 9/443 218/22
8,138,440 B2 3/2012 Onufriyenko et al.
8,248,193 B2 8/2012 Kaneda et al.
8,791,777 B2 7/2014 Wan
9,064,664 B2 6/2015 Yamamoto et al.
9,532,476 B2 12/2016 Mills et al.
2003/0090351 A1 5/2003 Chen et al.
2004/0109293 A1 6/2004 Apfelbacher et al.
2004/0257182 A1 * 12/2004 Saruwatari ..... H01H 50/08 335/129
2004/0263293 A1 * 12/2004 Saruwatari ..... H01H 50/326 335/128
2005/0007221 A1 * 1/2005 Saruwatari ..... H01H 50/08 335/128
2005/0052263 A1 * 3/2005 Saruwatari ..... H01H 50/08 335/17
2005/0242907 A1 * 11/2005 Minowa ..... H01H 50/443 335/129
2007/0126538 A1 6/2007 Liu
2009/0066450 A1 * 3/2009 Yano ..... H01H 49/00 335/203
2009/0072935 A1 3/2009 Yuba et al.
2010/0060394 A1 3/2010 Nagura et al.
2010/0066471 A1 * 3/2010 Nagura ..... H01H 9/047 335/201
2010/0165535 A1 7/2010 Pohl
2010/0265629 A1 10/2010 Beckerman
2011/0181381 A1 * 7/2011 Sasaki ..... H01H 9/443 335/78
2012/0206222 A1 * 8/2012 Gruner ..... H01H 1/54 335/177
2012/0313737 A1 12/2012 Iwamoto et al.
2013/0057369 A1 * 3/2013 Yano ..... H01H 1/66 335/156
2013/0240495 A1 * 9/2013 Yano ..... H01H 9/36 219/123
2013/0293324 A1 11/2013 Fujimoto et al.
2014/0225688 A1 * 8/2014 Masui ..... H01H 50/642 335/189
2014/0225689 A1 * 8/2014 Masui ..... H01H 50/642 335/194
2014/0265995 A1 9/2014 Kinsella et al.
2015/0042423 A1 * 2/2015 Hoffmann ..... H01H 50/541 335/133
2015/0055268 A1 2/2015 Chapel et al.
2015/0235791 A1 8/2015 Agarwal et al.
2017/0076893 A1 * 3/2017 Tsutsui ..... H01H 50/023
2017/0076894 A1 * 3/2017 Tsutsui ..... H01H 50/041
2017/0301494 A1 10/2017 Itoda et al.
2017/0301495 A1 * 10/2017 Hayashida ..... H01H 50/38
2017/0301496 A1 * 10/2017 Hayashida ..... H01H 50/38
2017/0309429 A1 * 10/2017 Hayashida ..... H01H 50/38

FOREIGN PATENT DOCUMENTS

CN 101667508 A 3/2010
CN 102129935 A 7/2011
CN 102820172 A 12/2012
CN 103367042 A 10/2013
JP S51-104337 U 8/1976
JP S56-37351 U 4/1981
JP S60-107551 U 7/1985
JP H01-103242 U 7/1989
JP H6-9102 U 2/1994
JP H10-214554 A 8/1998
JP 2000-299045 A 10/2000
JP 2009-224150 A 10/2009
JP 2010-177159 A 8/2010
JP 2012-221701 A 11/2012
JP 2013-080692 A 5/2013

OTHER PUBLICATIONS

The U.S. Office action dated Mar. 12, 2018 in the related U.S. Appl. No. 15/509,914.
The Chinese Office Action dated Apr. 4, 2018 in a related Chinese Patent application.
The Chinese Office Action dated Apr. 3, 2018 in a related Chinese Patent application.
The Chinese Office Action dated Mar. 30, 2018 in a counterpart Chinese Patent application.
U.S. Office action dated Sep. 27, 2018 in the related U.S. Appl. No. 15/509,998.

* cited by examiner

ELECTROMAGNETIC RELAY

TECHNICAL FIELD

The present invention relates to an electromagnetic relay, and more particularly to an electromagnetic relay provided with an insulation structure having high insulating property.

BACKGROUND ART

Conventionally, there has been known an electromagnetic relay which has a terminal, connecting structure of electric equipment which is formed of: as one example thereof, an external terminal provided with an electric connecting part which projects from an upper surface of a base; and a relay terminal which is formed by bending an elastic plate-like body having conductivity into an approximately U shape, is press-fitted into a recessed portion of an internal constitutional part mounted on the base, is electrically connected, to the internal constitutional part, and clamps the electric connecting part of the external terminal by facing portions thereof on both sides.

Particularly, the above-mentioned electromagnetic relay has a terminal connecting structure of electric equipment which is characterized by being formed of: a fixing lug portion which brings the facing portions on both sides of the relay terminal into pressure contact with inner surfaces of the recessed portion of the internal constitutional part; and a clamping lug part which is elastically deformed in a plate thickness direction independently from the fixing lug portion and clamps the electric connecting portion of the outer terminal (see patent literature 1).

CITATION LIST

Patent Literature

PTL 1: JP-UM-A-6-9102

SUMMARY OF INVENTION

Technical Problem

However, as shown in FIG. 5, in the electromagnetic relay described above, an insulation distance between a magnetic pole portion of a stacked iron core 6 which forms an electromagnet block 10 and a fixed contact is short thus giving rise to a drawback that the electromagnetic relay has low insulating property.

The present invention has been made in view of such drawbacks, and it is an object of the present invention to provide an electromagnetic relay having high insulating property.

Solution to Problem

To overcome the above-mentioned drawbacks, an electromagnetic relay according to the present invention includes:

a base;

an electromagnet block having a spool in which a through hole opening at a flange portion is formed, she electromagnet block being mounted on an upper surface of the base;

a movable iron piece configured to be rotatable based on excitation and non-excitation of the electromagnet block;

a movable contact piece configured to be rotatable integrally with the movable iron piece;

a movable contact fixed to a free end of the movable contact piece; and a fixed contact fixed to a fixed contact terminal, and disposed so as to be connected with and separable from the movable contact along with rotation of the movable contact piece, wherein an insulating rib is formed in a projecting manner on at least one of an inward facing surface of a spacer integrally formed with the movable iron piece and an outward facing surface of the flange portion such that the insulating rib intercepts a straight line which connects a magnetic pole portion which is one end portion of an iron core which projects from the through hole and the fixed contact or the fixed contact terminal with a shortest distance.

Advantageous Effects of Invention

According to the present invention, at least one insulating rib is disposed between the magnetic pole portion of the iron core and the fixed contact and hence, an insulation distance becomes long whereby an electromagnetic relay having favorable insulating property can be obtained.

As an embodiment of the present invention, an insulating rib mounted on the inward facing surface of the spacer in a sidewardly projecting manner may be disposed in a direction toward the magnetic pole portion from the fixed contact.

According to the embodiment, the insulating rib mounted on the inward facing surface of the spacer in a sidewardly projecting manner is disposed between the magnetic core portion of the iron core and the fixed contact and hence, an insulation distance becomes long whereby an electromagnetic relay having favorable insulating property can be obtained.

As another embodiment of the present invention, an insulating rib mounted on the outward facing surface of the flange portion in a sidewardly projecting manner may be disposed in a direction and the magnetic pole portion from the fixed contact.

According to the embodiment, the insulating rib mounted on the outward facing surface of the flange portion in a sidewardly projecting manner is disposed between the magnetic core portion of the iron core and the fixed contact and hence, an insulation distance becomes long whereby an electromagnetic relay having favorable insulating property can be obtained.

As another embodiment of the present invention, the insulating rib mounted on the outward facing surface of the flange portion in a sidewardly projecting manner may be disposed such that the insulating rib intercepts a straight line which connects a distal end of the insulating rib mounted on an inward facing surface of the spacer in a sidewardly projecting manner and the magnetic pole portion with a shortest distance.

The embodiment can acquire an advantageous effect where a longer meandering space is formed and hence, an insulation distance becomes long whereby an electromagnetic relay having further favorable insulating property can be acquired.

DESCRIPTION OF EMBODIMENTS

An electromagnetic relay according to an embodiment of the present invention is described with reference to attached drawings shown in FIG. 1A to FIG. 13D.

Figure 1A:
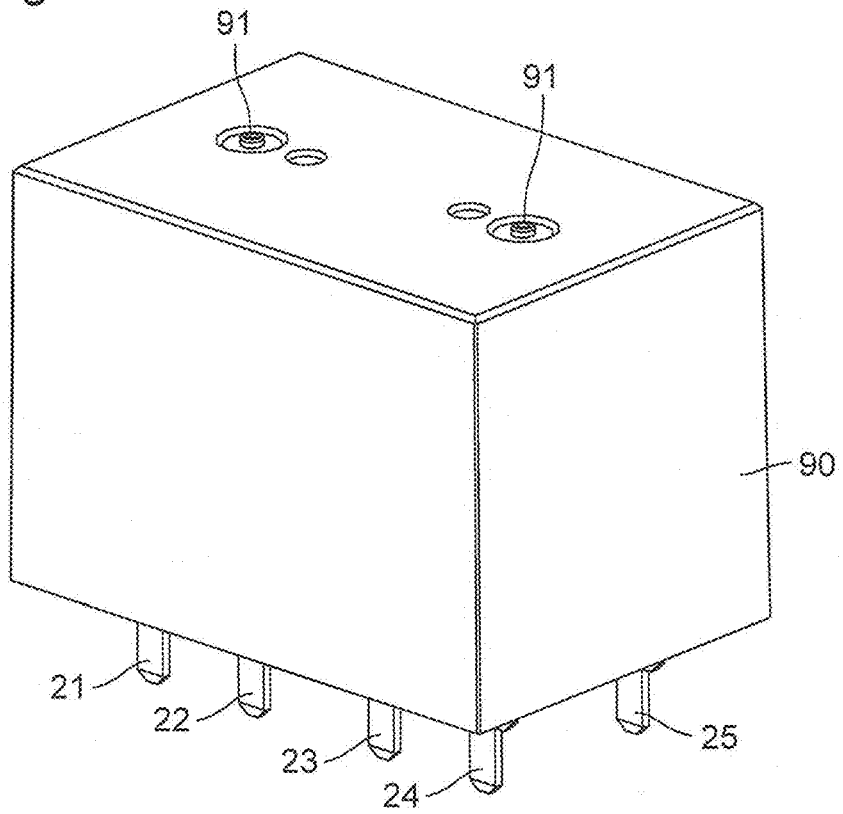
FIG. 1A is an overall perspective view of an electromagnetic relay according to the present invention as viewed from an oblique upper side.
Figure 1B:
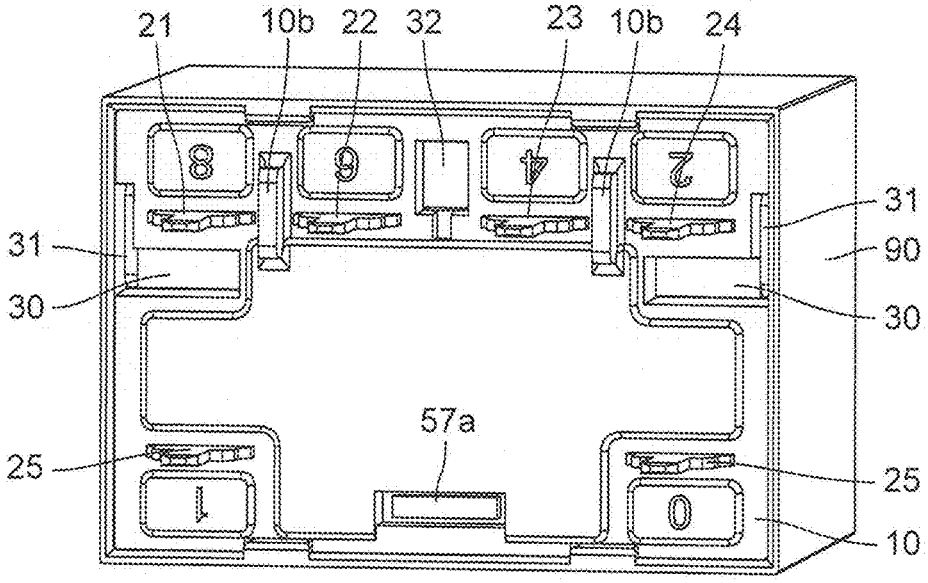
FIG. 1B is an overall perspective view of the electromagnetic relay as viewed from an oblique lower side.
Figure 2A:
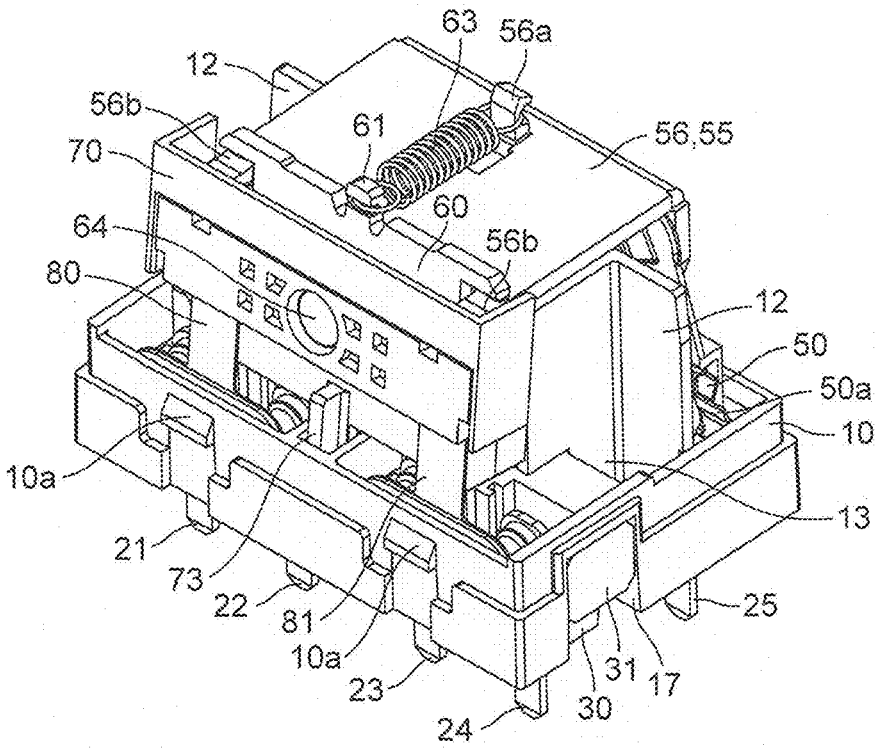
FIG. 2A is an overall perspective view of the electromagnetic relay according to the present invention as viewed from an oblique upper side in a state where a cover is removed from the electromagnetic relay.
Figure 2B:
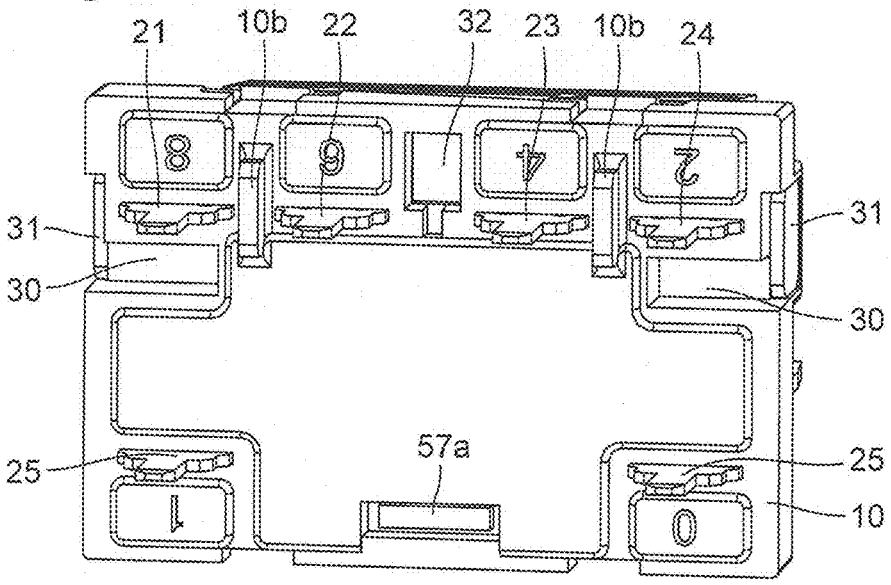
FIG. 2B is an overall perspective view of the electromagnetic relay as viewed from an oblique lower side in a state where the cover is removed from the electromagnetic relay.
Figure 3:
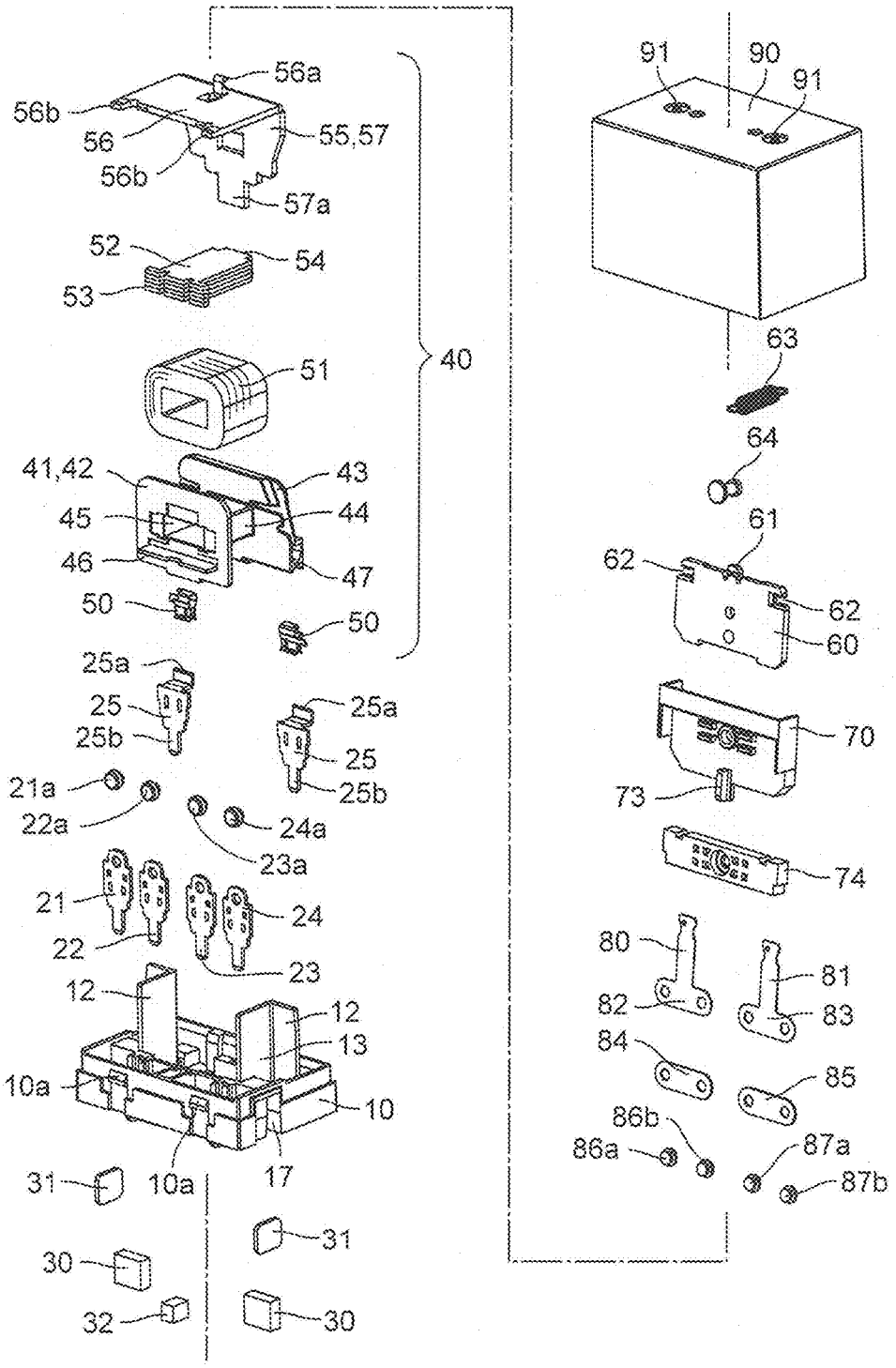
FIG. 3 is an exploded perspective view of the electromagnetic relay shown in FIG. 1A as viewed from an oblique upper side.
Figure 4:
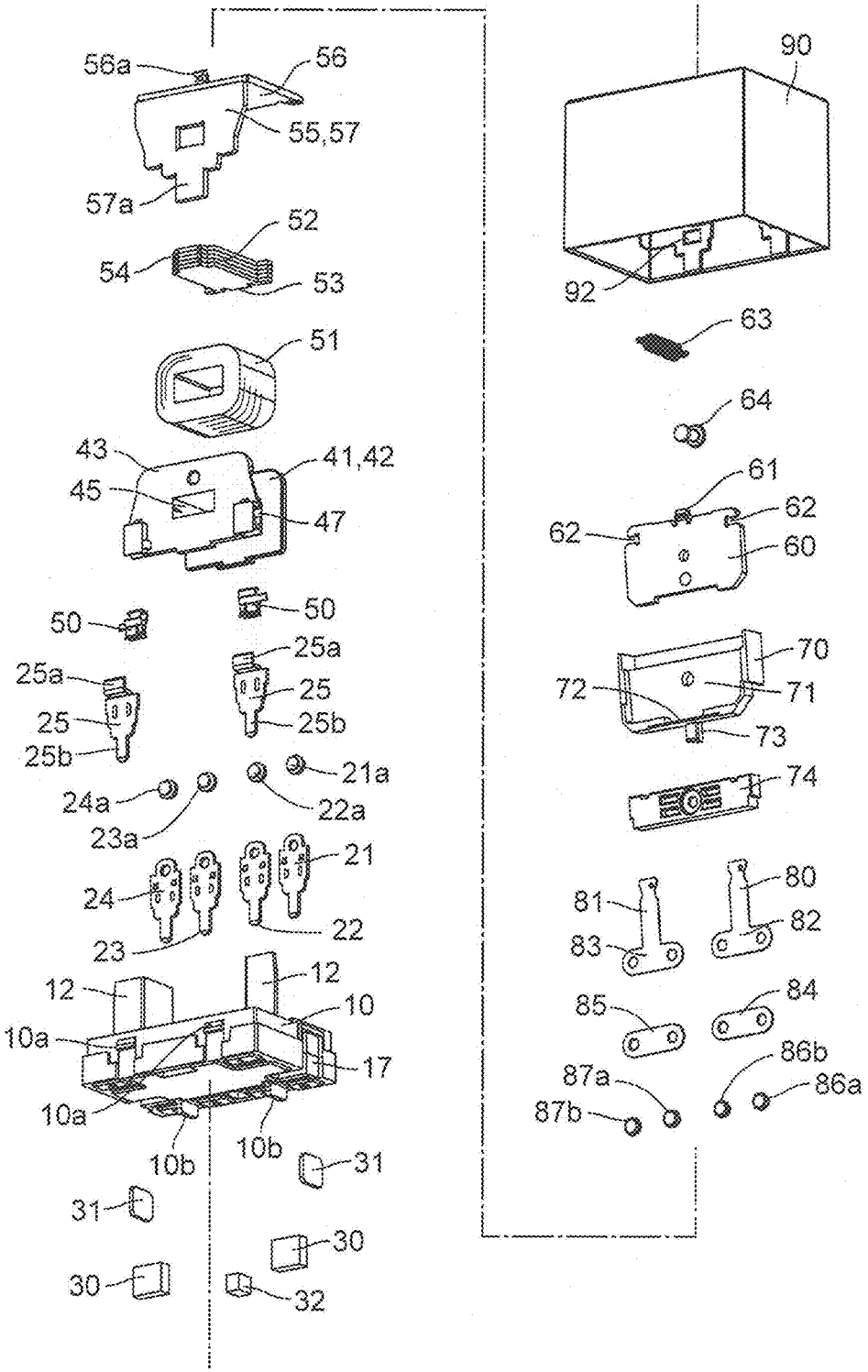
FIG. 4 is an exploded perspective view of the electromagnetic relay shown in FIG. 1A as viewed from an oblique lower side.
Figure 5A:
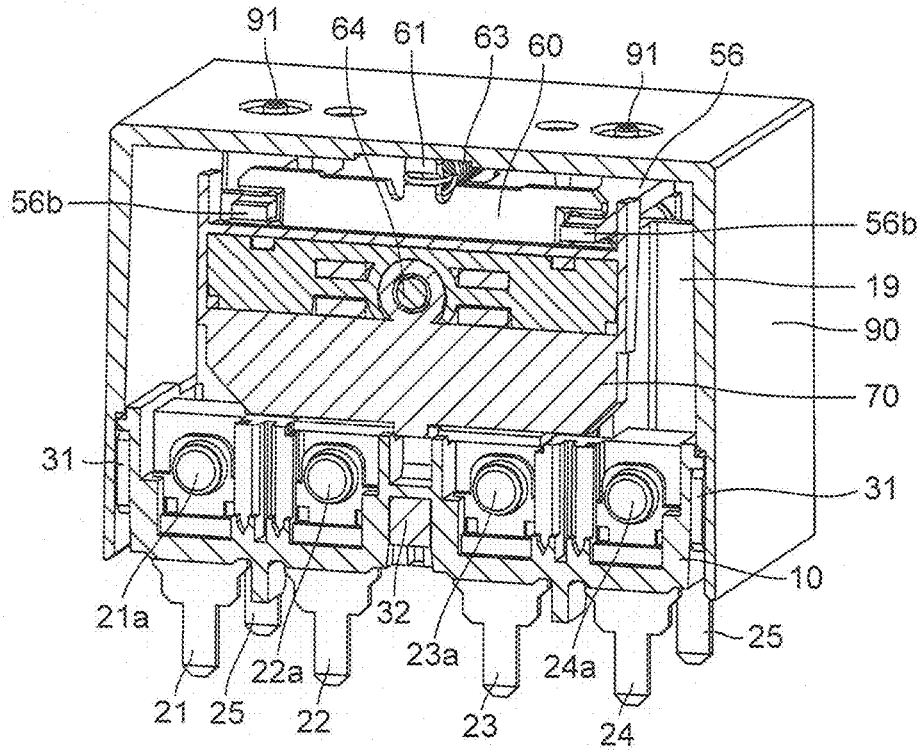
FIG. 5A and FIG. 5B are transverse cross-sectional views of the electromagnetic relay taken along at different positions.
Figure 5B:
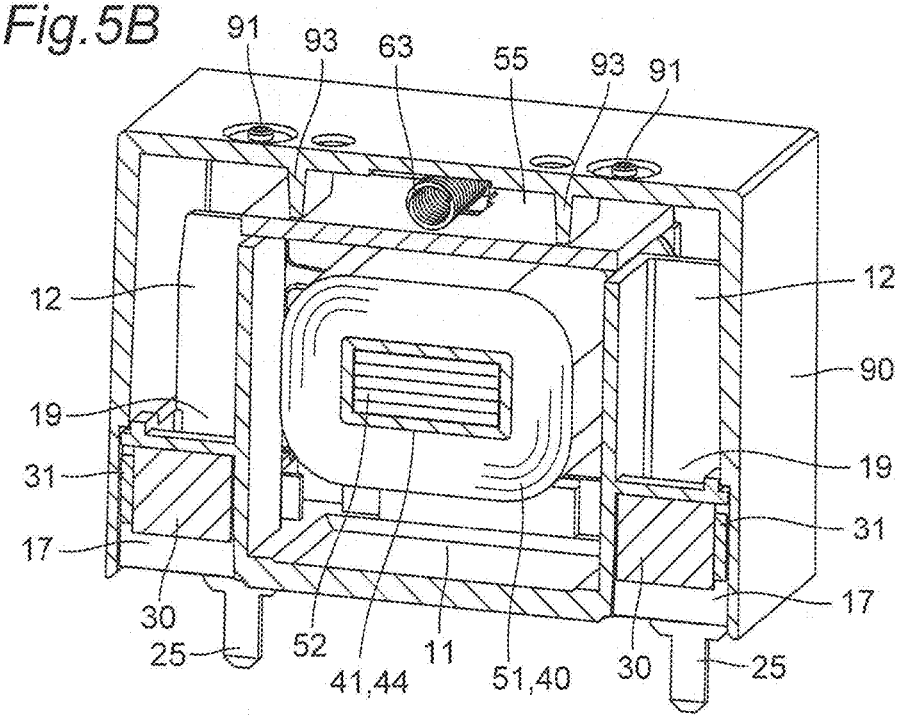

As shown in FIG. 3 and FIG. 4, the electromagnetic relay according to this embodiment substantially includes: a base 10; fixed contact terminals 21 to 24; an electromagnet block 40; a movable iron piece 60; movable contact pieces 80, 81; and a cover 90.

Figure 10A:
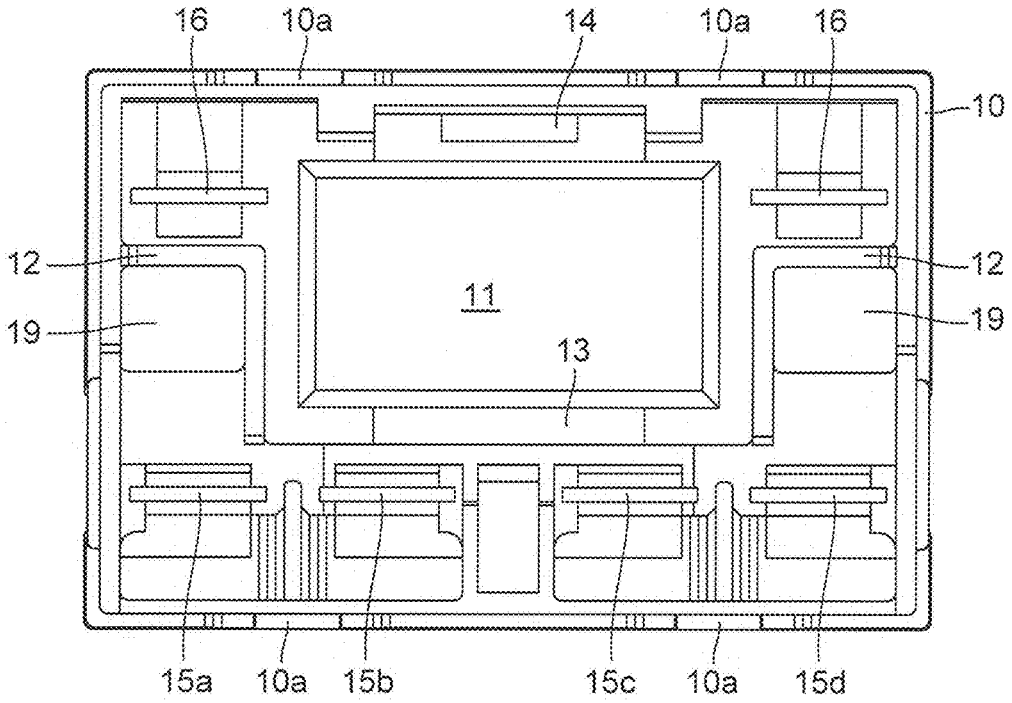
FIG. 10A and FIG. 10B are a plan view and a bottom view of the base.

On the base 10, as shown in FIG. 10A, a pair of partition walls 12, 12 having an L-shaped cross section is formed in a projecting manner on both left and right sides of a recessed portion 11 formed at the center of an upper surface of the base 10. On the base 10, edge portions which face each other in the longitudinal direction are disposed with the recessed portion 11 interposed therebetween. A stepped portion 13 is formed on one edge portion and a press-fitting hole 14 is formed in the other edge portion. The stepped portion 13 is provided for supporting a spool 41 of an electromagnet block 40 described later. The press-fitting hole 14 is provided for allowing the press-fitting of a lower end portion 57*a* of a yoke 55 of the electromagnet block 40. Out of the edge portions which face each other on the upper surface of the base 10, terminal holes 15*a* to 15*d* are disposed on the same straight line along one edge portion, and terminal holes 16, 16 are formed along the other edge portion. On the base 10, arc extinguishing spaces 19, 19 are formed between the partition walls 12, 12 and the terminal holes 15*a*, 15*d*. A pair of engaging claw portions 10*a* is formed on outer side surfaces of the base 10 which face each other with the partition walls 12, 12 interposed therebetween.

This embodiment has an advantageous effect that large-sizing of the electromagnetic relay can be avoided by effectively making use of dead spaces of the base 10 as the arc extinguishing spaces 19.

Figure 10B:
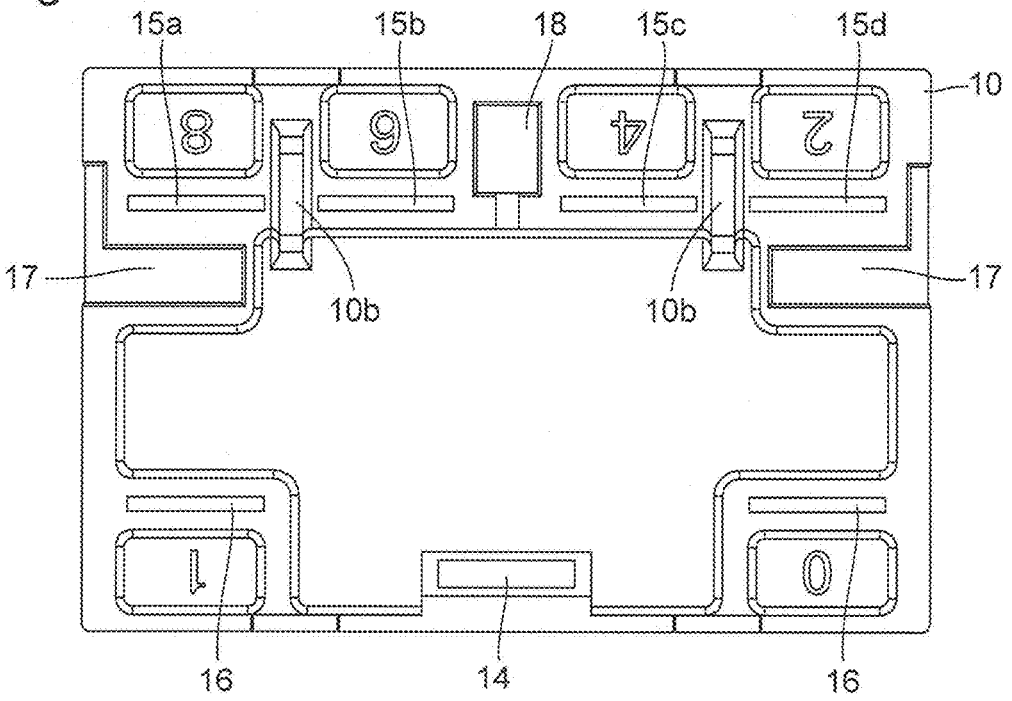
Figure 11A:
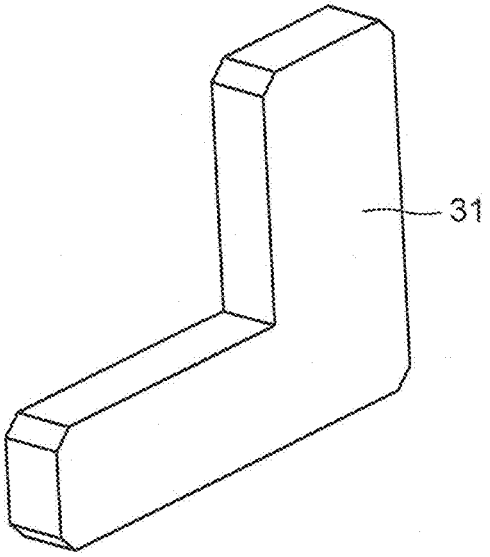
FIG. 11A and FIG. 11B are a perspective view and a right side view of a modification of an auxiliary yoke.
Figure 11B:
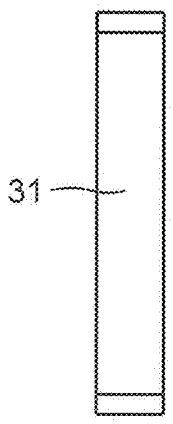
Figure 11C:
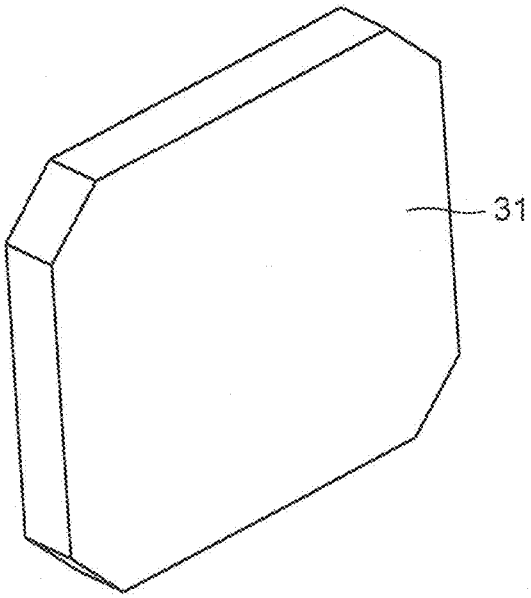
FIG. 11C and FIG. 11D are a perspective view and a right side view of another modification of the auxiliary yoke.
Figure 11D:
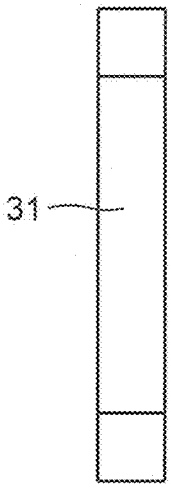

As shown in FIG. 10B, on a lower surface of the base 10, behind the terminal holes 15*a*, 15*d* in which the fixed contact terminals 21, 24 are inserted (the direction toward a side opposite to a mounting direction of movable contacts 86*a*, 87*b* described later as viewed from the above-mentioned terminal holes 15*a*, 15*d*), notched grooves 17, 17 having an approximately L shape which are recessed portions are disposed respectively. A portion of the notched groove 17 communicates with the outside from a side surface of the base 10 so that a first permanent magnet 30 and an auxiliary yoke 31 described later can be housed in the notched groove 17. The base 10 has a recessed portion 18 in which a second permanent magnet 32 described later is housed between the above-mentioned terminal holes 15*b*, 15*c*. A pair of ribs 10*b*, 10*b* is formed on a lower surface of the base 10 in a projecting manner for eliminating inclination when the electromagnetic relay according to the present invention is mounted on a surface of a substrate.

As shown in FIG. 3 and FIG. 4, fixed contacts 21*a* to 24*a* are fixed to upper end portions of the fixed contact terminals 21 to 24, and terminal portions 21*b* to 24*b* are formed on lower end portions of the fixed contact terminals 21 to 24. By inserting the terminal portions 21*b* to 24*b* into the terminal holes 15*a* to 15*d* of the base 10, the fixed contacts 21*a* to 24*a* are aligned on the same straight line. The reason four fixed contacts 21*a* to 24*a* are disposed as described above is that load voltages applied to the fixed contacts 21*a* to 24*a* individually are lowered when a DC power source circuit is turned on or off so that the generation of an arc can be suppressed.

The coil terminal 25 has a bent connecting portion 25*a* on an upper end portion thereof, and has a terminal portion 25*b* on a lower end portion thereof. By press-fitting the terminal portions 25*b* into the terminal holes 16 formed in the base 10, the coil terminals 25, 25 are aligned on the same straight line.

The direction of an electric current which flows between the fixed contacts 21*a* to 24*a* and the movable contacts 86*a*, 86*b*, 87*a*, 87*b* and the directions of a magnetic pole of the first permanent magnet 30 and a magnetic pole of the second magnet 32 are determined. Accordingly, the first permanent magnet 30, the auxiliary yoke 31, and the second permanent magnet 32 induce, extend, and extinguish arcs which are generated between the fixed contacts 21*a*, 22*a*, 23*a*, 24*a* and the movable contacts 86*a*, 86*b*, 87*a*, 87*b* in a predetermined direction respectively. Particularly, the auxiliary yoke 31 is provided for changing lines of a magnetic force of the first magnet 30 to a desired direction so as to adjust an arc inducing direction, for eliminating leakage of a magnetic flux of the first permanent magnet 30, and for increasing magnetic efficiency.

Figure 6A:
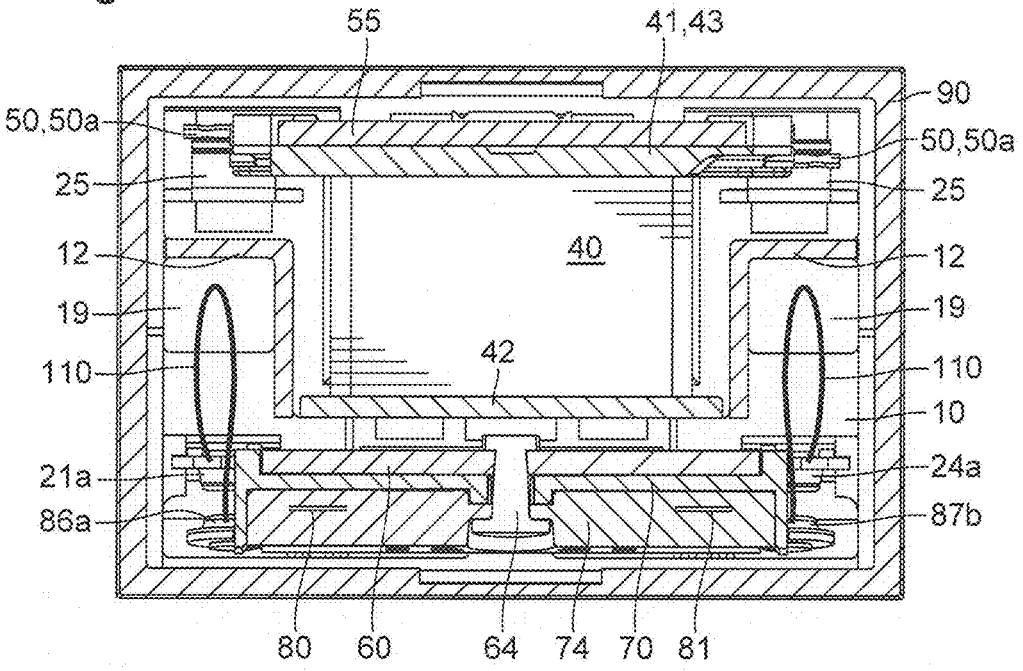
FIG. 6A and FIG. 6B are horizontal cross-sectional views of the electromagnetic relay taken along at different positions.
Figure 6B:
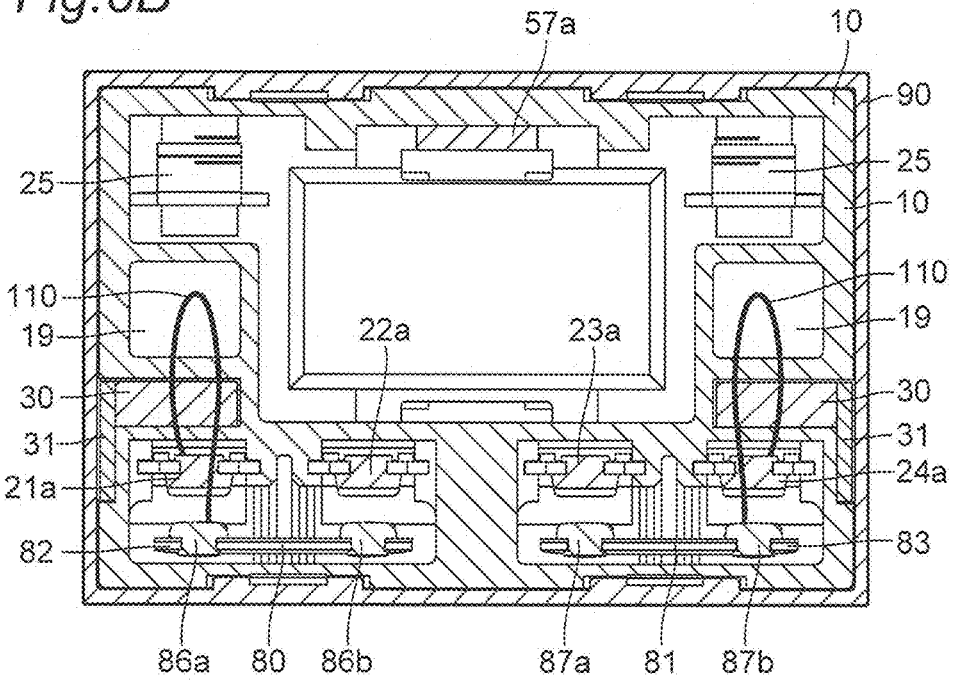

That is, as shown in FIG. 6, an arc generated between the fixed contact 21*a* and the movable contact 86*a* is induced in the direction toward a side opposite to the movable contact 86*b* as viewed from the fixed contact 21*a*.

An arc generated between the fixed contact 24*a* and the movable contact 87*b* is induced in the direction toward a side opposite to the movable contact 87*b* as viewed from the fixed contact 24*a*.

An arc generated between the fixed contact 22*a* and the movable contact 86*b* is induced toward the upper surface of the base 10.

An arc generated between the fixed contact 23*a* and the movable contact 87*a* is induced in a direction toward a side opposite to the upper surface of the base 10.

Although the electromagnetic relay according to this embodiment has four poles, an arc generated between the fixed contact 22*a* and the movable contact 86*b* which face each other and an arc generated between the fixed contact 23*a* and the movable contact 87*a* which face each other can be induced in the predetermined directions by three permanent magnets. Accordingly, the electromagnetic relay according to this embodiment has an advantage that the number of parts can be reduced compared to the prior art.

By inserting the first permanent magnet 30 and the auxiliary yoke 31 into the notched grooves 17 formed on the base 10 respectively, the auxiliary yoke 31 is positioned so as to be disposed adjacently to the first permanent magnet 30. The second permanent magnet 32 is housed in the recessed portion 18 formed on the base.

According to this embodiment, the first and second permanent magnets 30, 32 and the auxiliary yokes 31 are assembled from the lower surface of the base 10 and hence, it is possible to prevent the deterioration of the first and second permanent magnets 30, 32 and the auxiliary yoke 31 caused by a generated arc. Further, a thickness of the base 10 can be effectively utilized and hence, it is possible to provide a space saving electromagnetic relay.

It is not always necessary to assemble all of the first permanent magnets 30, the auxiliary yokes 31, and the second permanent magnet 32 from the lower surface of the base 10. These parts may be assembled from the upper surface of the base 10 when necessary.

The permanent magnets or, the permanent magnet and the auxiliary yokes may be disposed behind the fixed contacts 21*a* to 24*a*.

Figure 12A:
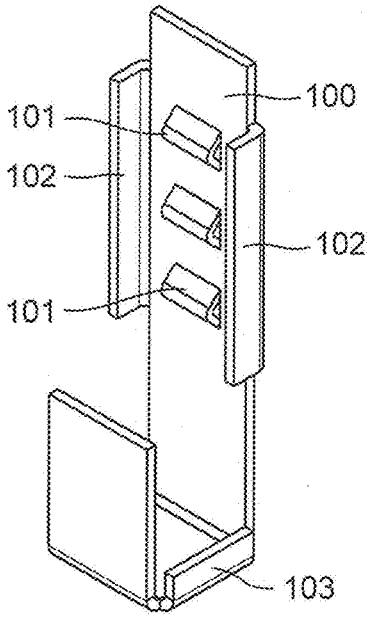
FIG. 12A and FIG. 12B are a perspective view and a longitudinal cross-sectional view of an arc cut-off member.

The above-mentioned auxiliary yoke 31 may not be limited to a rectangular plate-like magnetic member. For example, the auxiliary yoke 31 may have an approximately L shape as viewed in a front view (FIG. 12A). According to such a modification, by changing the direction of lines of a magnetic force of the first permanent magnet 30 into a different direction, an inducing direction of an arc can be changed into a desired direction.

Figure 12B:
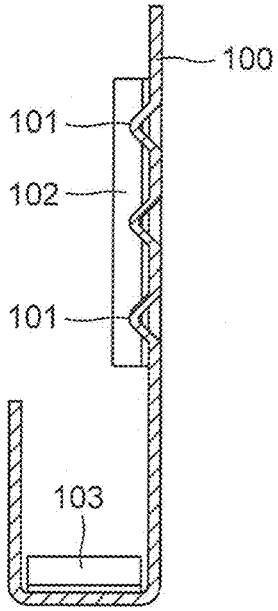

The above-mentioned auxiliary yoke 31 may be formed of a rectangular plate-like magnetic member where corner portions are chamfered (FIG. 12B). According to such a modification, the corner portions are chamfered and hence, the auxiliary yoke 31 can be easily inserted into the notched groove 17 thus giving rise to an advantage that assembling performance is improved.

In the arc extinguishing space 19, for efficiently extinguishing a generated arc by rapid cooling, for example, an arc cut-off member 100 shown in FIG. 12A and FIG. 12B may be disposed.

The arc cut-off member 100 is formed by bending a strip-shaped metal plate into an approximately J-shape in cross section. On a front surface of the arc cut-off member 100, a plurality of projections 101 having an approximately triangular shape are formed in a projecting manner. The projections 101 are formed so as to increase a rapid cooling effect by increasing a contact area with an arc. Ribs 102 are bent and raised from both side edge portions at the front surface of the arc cut-off member 100 such that the ribs 102 face each other, and ribs 103 are also bent and raised from both side edge portions at a bottom surface of the arc cut-off member 100 such that the ribs 103 face each other. The ribs 102, 103 are provided for preventing a generated arc from leaking out from the arc extinguishing space 19.

Figure 12C:
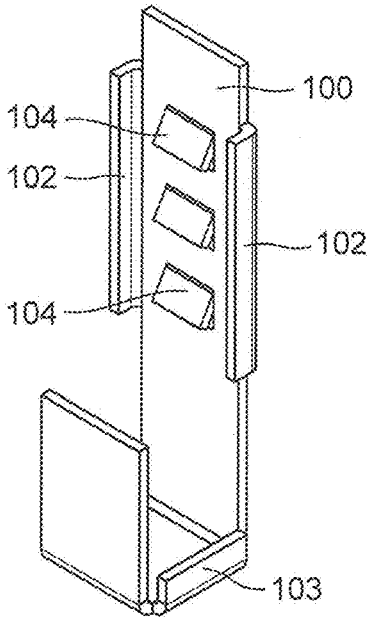
FIG. 12C and FIG. 12D are a perspective view and a longitudinal cross-sectional view of another arc cut-off member.
Figure 12D:
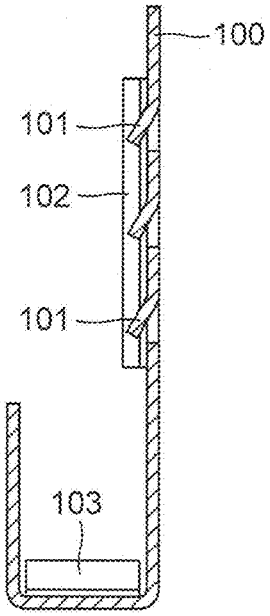
Figure 13A:
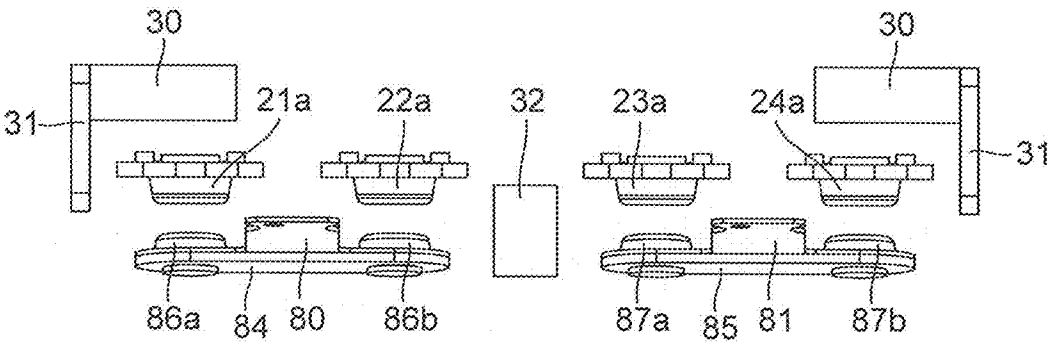
FIG. 13A and FIG. 13B are schematic plan view and a schematic front view of a contact mechanism.
Figure 13B:
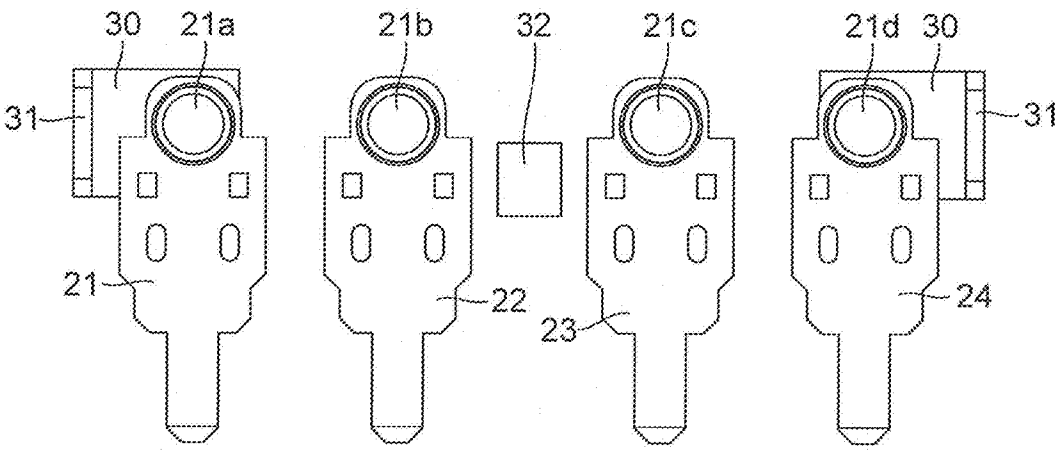

As another arc cut-off member 100, for example, as shown in FIG. 12C and FIG. 12D, a plurality of tongue members 104 may be formed by cutting and raising on a front surface of the arc cut-off member 100. Other configurations of another arc cut-off member 100 are equal to the corresponding configurations of the above-mentioned arc cut-off member 100 and hence, the same numerals are given to identical parts and the description of the other configurations is omitted.

As shown in FIG. 3 and FIG. 4, the electromagnet block 40 is formed of the spool 41, the coil 51, the iron core 52, and the yoke 55.

Figure 7A:
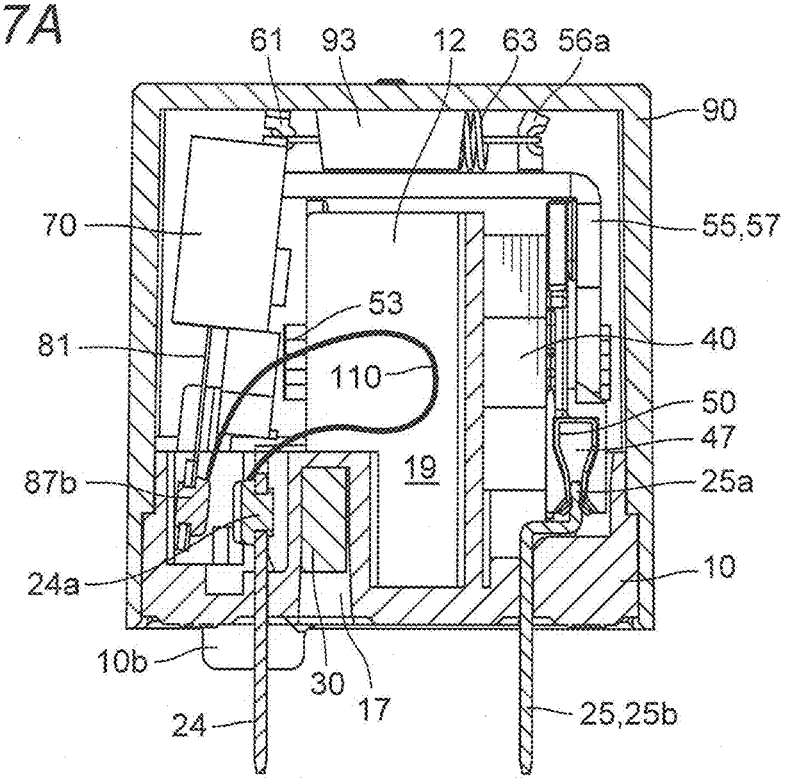
FIG. 7A and FIG. 7B are longitudinal cross-sectional views of the electromagnetic relay taken along at different positions.
Figure 7B:
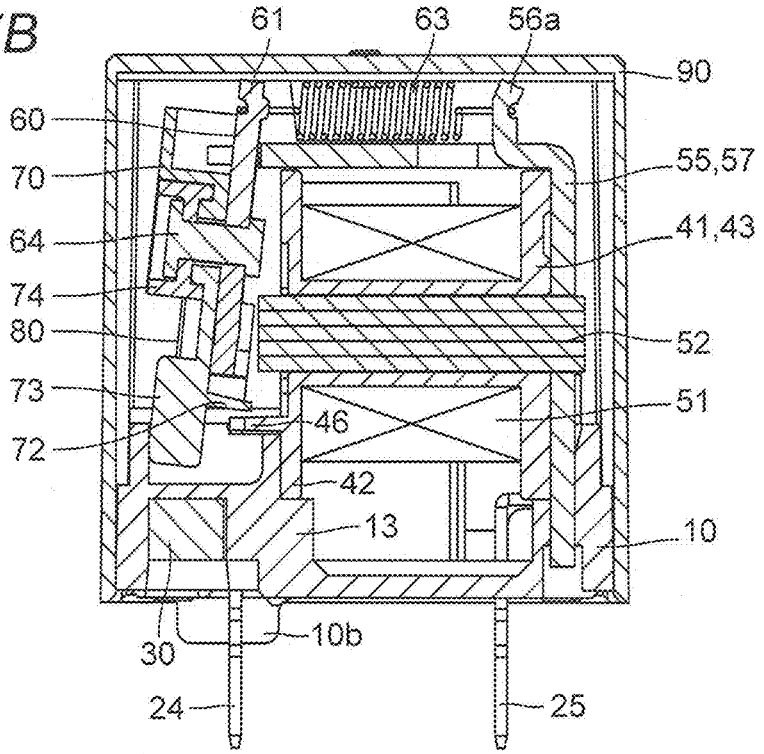

The spool 41 is configured such that a through hole 45 having a rectangular cross section is formed in a trunk portion 44 having flange portions 42, 43 on both ends thereof, and an insulation rib 46 is formed on an outward facing surface of one flange portion 42 such that the insulation rib 46 projects sideward. Engaging holes 47 are formed in both side edge portions of the other flange portion 43 of the spool 41, and relay clips 50 engage with the engaging holes 47 respectively thus preventing the removal of the spool 41 (FIG. 7B).

The coil 51 is wound around the trunk portion 44, and lead lines of the coil 51 are bound to binding portions 50*a* (FIG. 6A) which extend from the relay clips 50 and are soldered to the binding portions 50*a*.

The iron core 52 is formed by stacking a plurality of plate-like magnetic members having an approximately planar T-shape. The iron core 52 is made to pass through the through hole 45 formed in the spool 41, one end portion of the iron core 52 projecting from the through hole 45 forms a magnetic pole portion 53, and the other end portion 54 of the iron core 52 projecting from the through hole 45 is fixed by swaging to a vertical portion 57 of the yoke 55 having an approximately L shaped cross section described later.

The yoke 55 is formed of a magnetic plate bent in an approximately L-shape in cross section. An engaging projection 56*a* is formed at the center of a horizontal portion 56 by bending and raising, and support projections 56*b* are formed on both side edge portions of a distal end of the horizontal portion 56 by cutting. The yoke 55 is formed into a shape which allows press-fitting of a lower end portion 57*a* of the vertical portion 57 into the press-fitting hole 14 formed in the base 10.

As shown in FIG. 3 and FIG. 4, the movable iron piece 60 is formed of a plate-like magnetic member. An engaging projection 61 is formed on an upper side edge portion of the movable iron piece 60 in a projecting manner, and notched portions 62, 62 are formed on both side edge portions of the movable iron piece 60.

By making the notched portions 62 engage with the support projections 56*b* of the yoke 55 and by connecting the engaging projection 61 to the engaging projection 56*a* of the yoke 55 by way of a restoring spring 63, the movable iron piece 60 is rotatably supported by the yoke 55.

Movable contact pieces 80, 81 have an approximately T shape as viewed in a front view. The movable contacts 86*a*, 86*b*, 87*a*, 87*b* are fixed to both ends of large width portions 82, 83 of the movable contact pieces 80, 81 by way of lining members 84, 85 having conductivity. By substantially increasing cross-sectional areas of the large width portions 82, 83, the lining members 84, 85 can reduce electric resistance thus suppressing the generation of heat.

Upper end portions of the movable contact pieces 80, 81 are integrally formed with a movable base 74 by insert molding. As shown in FIG. 7B, the movable base 74 is integrally formed with a spacer 70 and the movable iron piece 60 by way of a rivet 64. As shown in FIG. 4, by allowing fitting of the movable iron piece 60 into a recessed portion 71 formed on an inward facing surface of the spacer 70, insulating property of the movable iron piece 60 is enhanced. An insulation rib 72 is formed on a lower side edge portion of the inward facing surface of the spacer 70, and an insulation rib 73 (FIG. 3) which partitions the movable contact pieces 80, 81 is formed on a lower side edge portion of an outward facing surface of the spacer 70 such that the insulation rib 73 projects sideward.

Figure 8A:
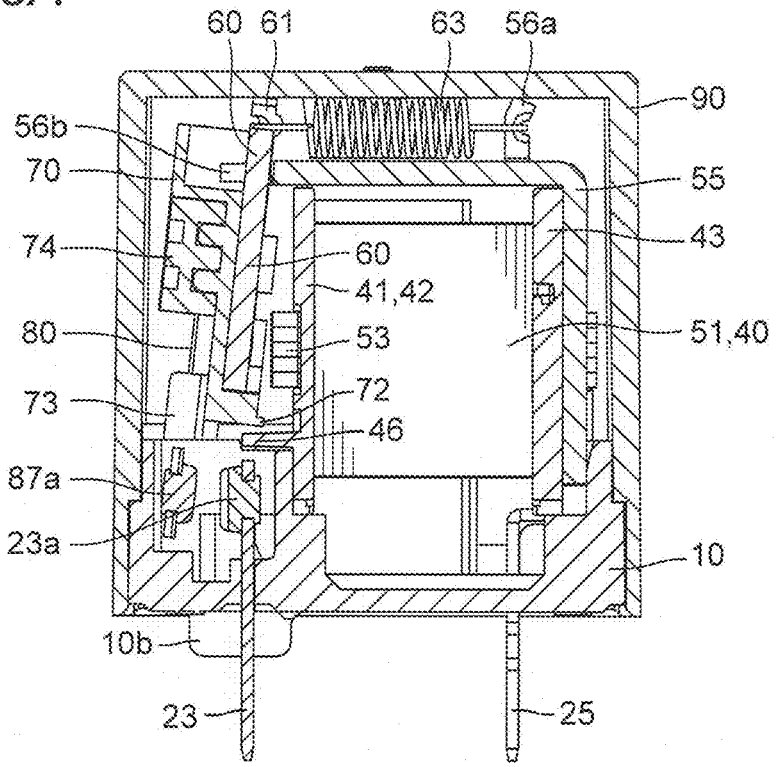
FIG. 8A and FIG. 8B are longitudinal cross-sectional views of the electromagnetic relay and a partially enlarged longitudinal cross-sectional view thereof.
Figure 8B:
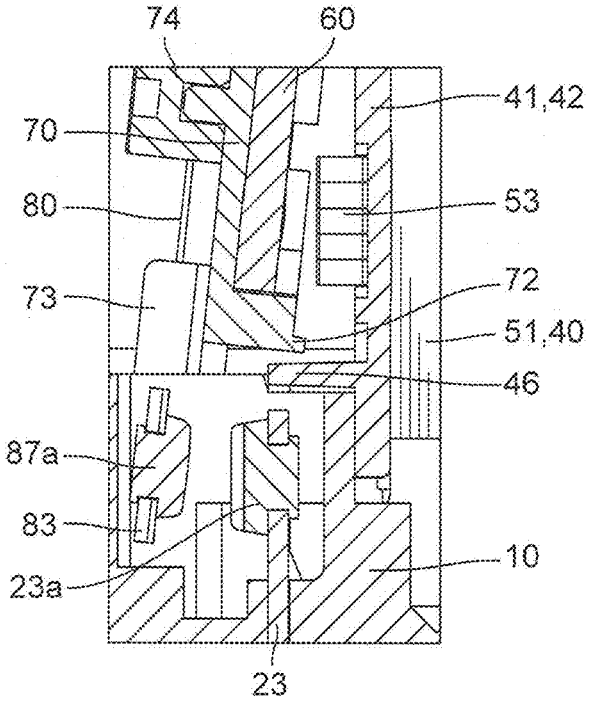

The electromagnet block 40 on which the movable contact pieces 80, 81 are mounted is housed in the base 10, and the flange portion 42 of the spool 41 is placed on the stepped portion 13 of the base 10. The lower end portion 57*a* of the yoke 55 is press-fitted into the press fitting hole 14 formed in the base 10 thus positioning the yoke 55. Accordingly, the relay clips 50 of the electromagnet block 40 clamp the connecting portion 25*a* of the coil terminal 25 (FIG. 7A). The movable contacts 86*a*, 86*b*, 87*a*, 87*b* face the fixed contacts 21*a* to 24*a* in a contactable and separable manner. As shown in FIG. 8, the insulation rib 72 of the spacer 70 is located in the vicinity of an area above the insulation rib 46 of the spool 41. However, the insulation rib 72 may be located in the vicinity of an area below the insulation rib 46.

To be more specific, at least either one of the insulation ribs 46, 72 is disposed such that the insulation ribs 46, 72 intercept a straight line which connects the fixed contact 22*a*, 23*a* or the fixed contact terminal 22, 23 with the magnetic pole portion 53 with a shortest distance. Accordingly, a clearance distance from the magnetic pole portion 53 of the iron core 52 to the fixing contact 22*a*, 23*a* becomes long so that high insulating property can be acquired.

Further, the insulation rib 46 may be disposed such that the insulation rib 46 intercepts a straight line which connects the fixed contact 22*a*, 23*a* or the fixed contact terminal 22, 23 with the magnetic pole portion 53 with a shortest distance, and the insulation rib 72 may be disposed such that the insulation rib 72 intercepts a straight line which connects a distal edge portion of the insulation rib 46 and the magnetic pole portion 53 with a shortest distance. With such an arrangement, a spatial distance from the magnetic pole portion 53 of the iron core 52 to the fixed contact 22*a*, 23*a* can be increased so that higher insulating property can be acquired.

It is preferable that a length of the insulation rib 46 which projects from the outward facing surface of the flange portion 42 be shorter than a distance from the outward facing surface of the flange portion 42 to the distal end of the fixed contact 22*a*, 23*a*. This is because when a length of the insulation rib 46 is longer than a distance from the outward facing surface of the flange portion 42 to the distal end of the fixed contact 22*a*, 23*a*, there is a possibility that an operation of the movable contact piece 80, 81 is obstructed. Another reason is that arcs which are respectively generated between the fixed contacts 22*a*, 23*a* and the movable contacts 86*b*, 87*a* are liable to impinge on the insulation rib 46 so that the insulation rib 46 is liable to be deteriorated. Accordingly, the more preferred length of the insulation rib 46 is the length from the outward facing surface of the flange portion 42 to the outward facing surface of the fixed contact terminal 22, 23.

As shown in FIG. 3 and FIG. 4, the cover 90 has a box shape such that the cover 90 can be fitted on the base 10 to which the above-mentioned electromagnet block 40 is assembled. A pair of gas releasing holes 91, 91 is formed in a ceiling surface of the cover 90. Engagement receiving portions 92 which engage with the engaging claw portions 10*a* of the base 10 are formed on facing inner surfaces of the cover 90, and position restricting ribs 93 are formed on an inner surface of the ceiling of the cover 90 in a projecting manner.

With such a configuration, when the cover 90 is fitted on the base 10 to which the electromagnet block 40 is assembled, the engagement receiving portions 92 of the cover 90 engage with the engaging claw portions 10*a* of the base 10 so that the cover 90 is fixed to the base 10. Then, the position restricting ribs 93 are brought into contact with the horizontal portion 56 of the yoke 55 so that lifting of the electromagnet block 40 can be restricted. Next, by hermetically sealing the base 10 and the electromagnet block 40 by injecting and solidifying a sealing material (not shown in the drawing) on a lower surface of the base 10, an assembling operation is completed.

According to this embodiment, simultaneously with sealing of a gap between the base 10 and the cover 90 by injecting the sealing material, the first and second permanent magnets 30, 32 and the auxiliary yokes 31 can be fixed to the base 10 and hence, the number of operation man-hours can be reduced whereby an electromagnetic relay can be obtained with high productivity.

Next, operation of the above-mentioned electromagnetic relay according to this embodiment is described.

When the electromagnet block 40 is not excited, as shown in FIG. 7 and FIG. 8, the movable iron piece 60 is biased in a counterclockwise direction by a spring force of the restoring spring 63. Accordingly, the movable contacts 86*a*, 86*b*, 87*a*, 87*b* are separated from the fixed contacts 21*a* to 24*a*.

Figure 9A:
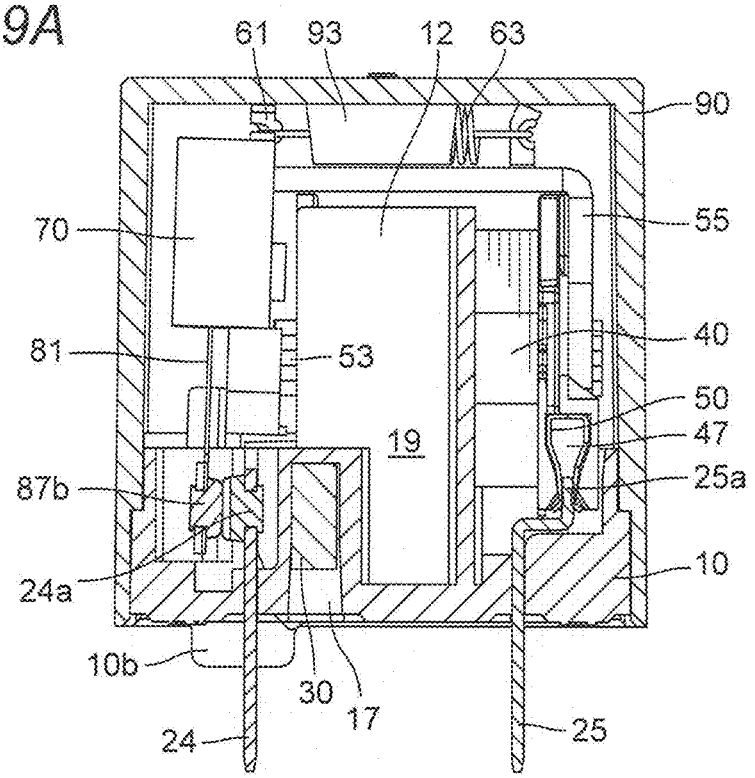
FIG. 9A and FIG. 9B are longitudinal cross-sectional views of the electromagnetic relay taken along at different positions after an operation is finished.
Figure 9B:
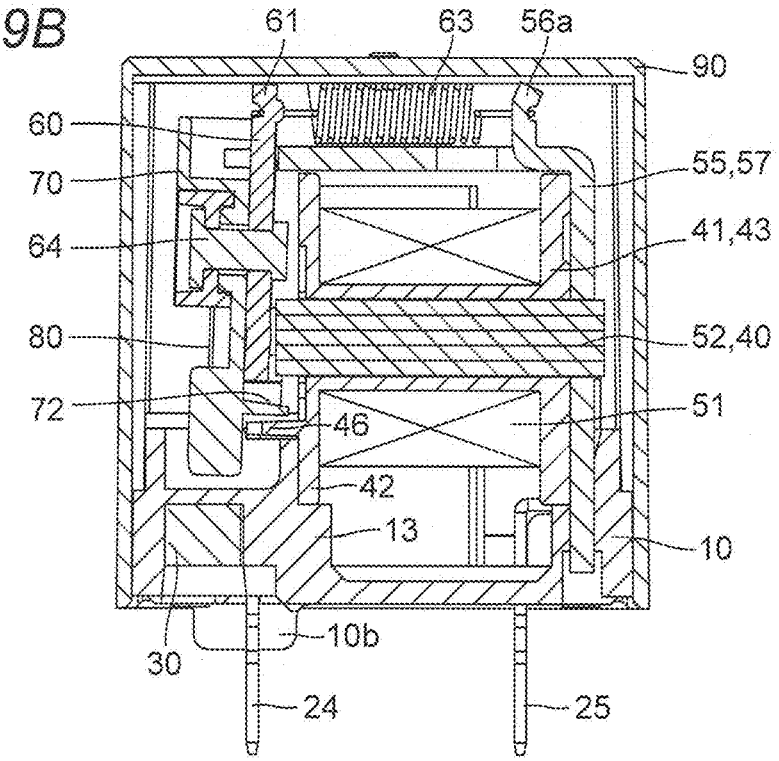

Then, when the coil 51 is excited due to applying of a voltage to the coil 51, the movable iron piece 60 is attracted to the magnetic pole portion 53 of the iron core 52 so that the movable iron piece 60 is rotated against a spring force of the restoring spring 63. Accordingly, the movable contact pieces 80, 81 are integrally rotated with the movable iron piece 60, the movable contacts 86*a*, 86*b*, 87*a*, 87*b* are brought into contact with the fixed contacts 21*a* to 24*a* and, thereafter, the movable iron piece 60 is attracted to the magnetic pole portion 53 of the iron core 52 (FIG. 9).

Next, when applying of a voltage to the coil 51 is stopped, the movable iron piece 60 is rotated in a clockwise direction due to a spring force of the restoring spring 63, the movable iron piece 60 is separated from the magnetic pole portion 53 of the iron core 52 and, thereafter, the movable contacts 86*a*,

86*b*, 87*a*, 87*b* are separated from the fixed contacts 21*a* to 24*a* and are restored to an original state.

According to this embodiment, as shown in FIG. 6 and FIG. 7, even when an arc 110 is generated when the movable contact 86*a*, 87*b* is separated from the fixed contacts 21*a*, 24*a*, lines of a magnetic force of the first permanent magnet 30 act on the arc through the auxiliary yoke 31. Accordingly, based on the Fleming's left-hand rule, the generated arc 110 is induced into the arc extinguishing space 19 of the base 10 by a Lorentz force, and is extended and extinguished.

According to this embodiment, only with the use of the first permanent magnet 30, the generated arc 110 can be induced to an area behind the fixed contact 21*a*, 24*a* and can be extinguished. However, by disposing the auxiliary yoke 31, the arc 110 can be induced to an area just behind the fixed contact 21*a*, 24*a*. Accordingly, the generated arc is extended to the area just behind the fixed contact 21*a*, 24*a* without being brought into contact with the inner surface of the cover 90 and hence, the arc 110 can be extinguished more efficiently.

Further, according to this embodiment, a dead space located behind the fixed contacts 21*a*, 24*a* is effectively used as the arc extinguishing space 19 and hence, the electromagnetic relay according to this embodiment has an advantage that large sizing of the device can be avoided.

It is needless to say that the shapes, the sizes, the materials, the arrangement, and the like of the first and second permanent magnets 30, 32 and the auxiliary yoke 31 are not limited to the above-mentioned values, and can be changed when necessary.

Working Example 1

In the working example 1, an analysis is made on the directions and magnitudes of lines of a magnetic force when the first and second permanent magnets 30, 32 and the auxiliary yoke 31 are combined with each other.

Figure 14A:
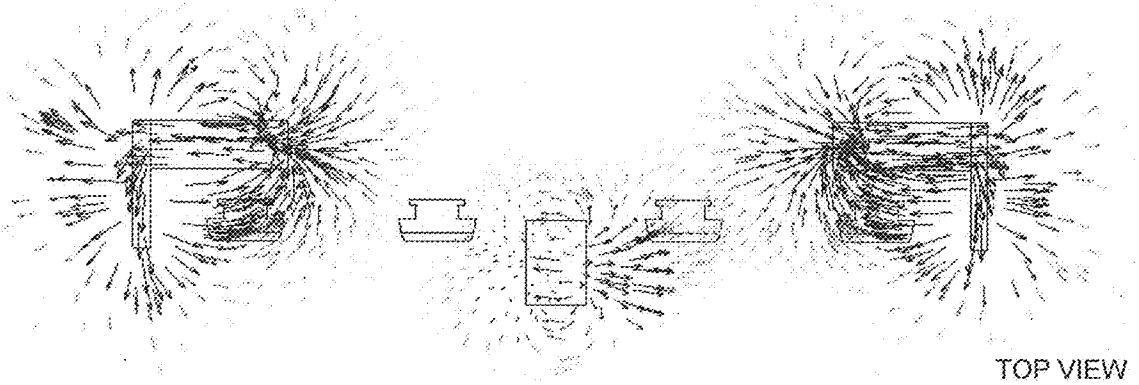
FIG. 14A and FIG. 14B are a plan view and a front view showing lines of magnetic force of permanent magnet of the electromagnetic relay according to a working example 1 as vector lines.
Figure 14B:
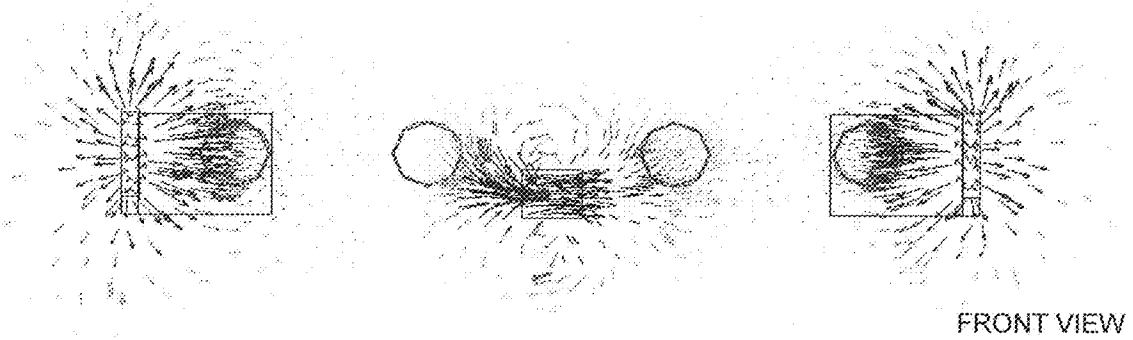
Figure 15A:
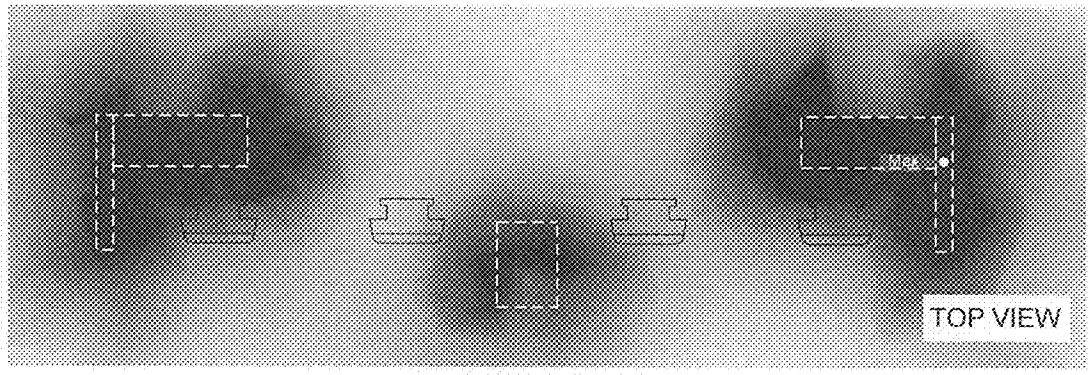
FIG. 15A and FIG. 15B are a plan view and a front view showing a magnetic flux density of the permanent magnet of the electromagnetic relay according to the working example 1 by concentration.
Figure 15B:
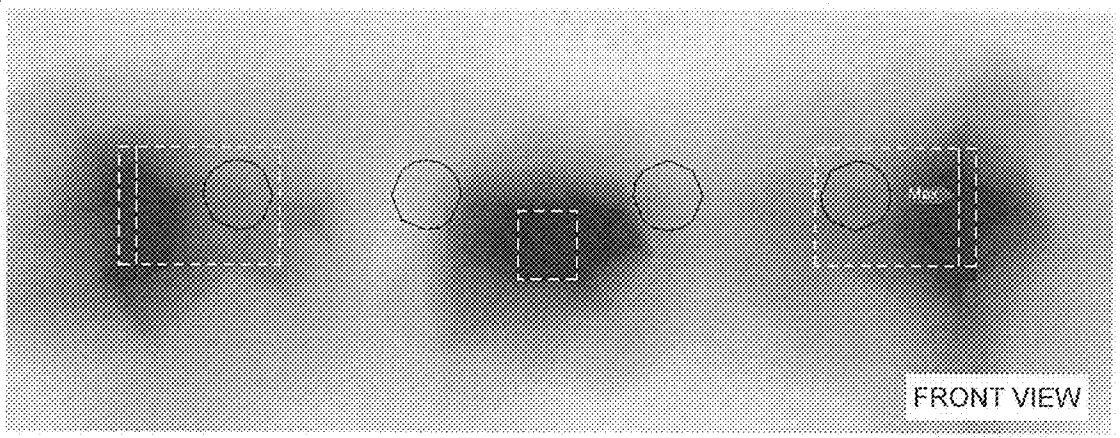

As a result of the analysis, the directions of the lines of a magnetic force are described by vector lines (FIGS. 14A and 14B) and magnitudes of the lines of the magnetic force are described in the form of concentration (FIGS. 15A and 15B).

Working Example 2

In the working example 2, an analysis is made on the directions and the magnitudes of lines of a magnetic force when the first and second permanent magnets 30, 32 are disposed in the same manner as the above-mentioned working example 1 except for that the working example 2 is not provided with the auxiliary yoke 31.

Figure 16A:
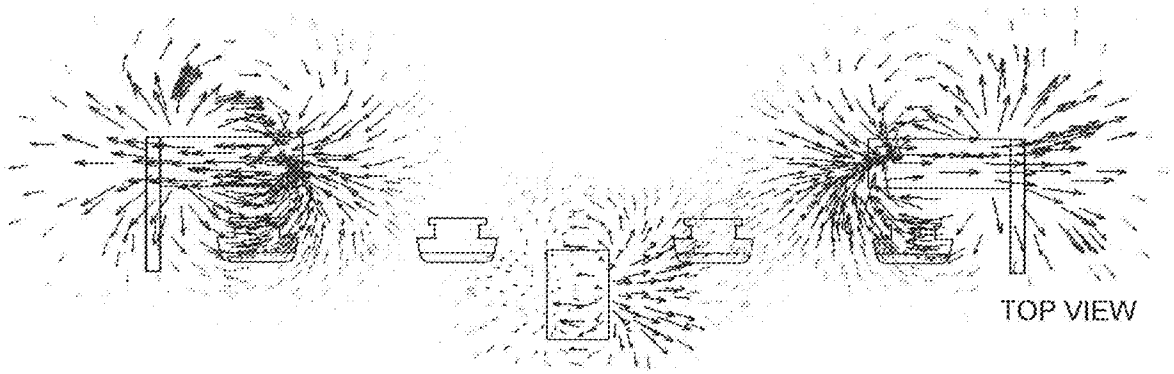
FIG. 16A and FIG. 16B are a plan view and a front view showing lines of magnetic force of an electromagnetic relay according to a working example 2 by vector lines.
Figure 16B:
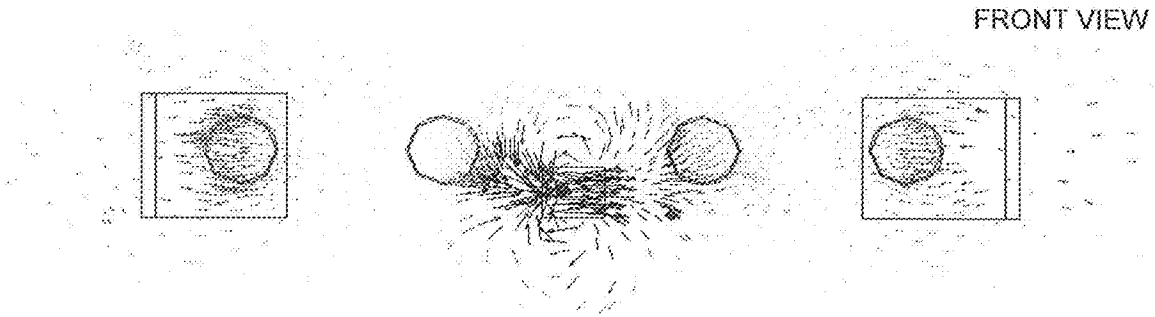
Figure 17A:
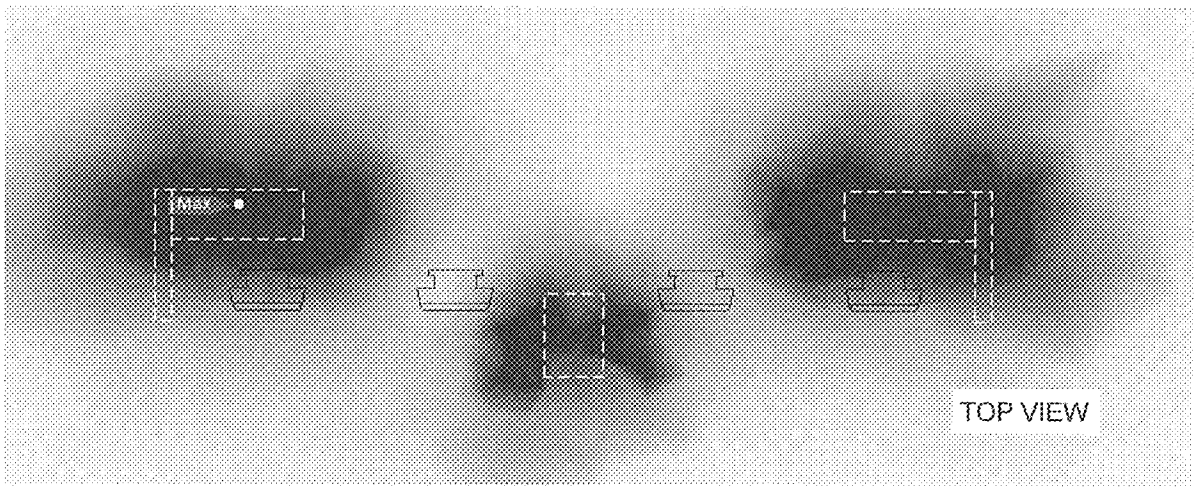
FIG. 17A and FIG. 17B are a plan view and a front view showing a magnetic flux density of the permanent magnet of the electromagnetic relay according to the working example 2 by concentration.
Figure 17B:
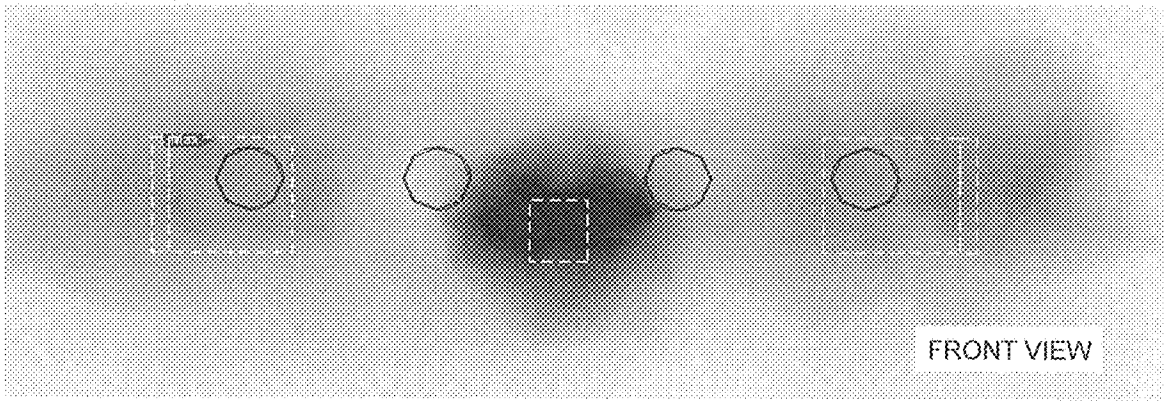

As a result of the analysis, the directions of the lines of a magnetic force are described by vector lines (FIGS. 16A and 16B) and magnitudes of the lines of the magnetic force are described in the form of concentration (FIGS. 17A and 17B).

By comparing the result of analysis described in FIGS. 14A and 14B and FIGS. 15A and 15B with the result of analysis described in FIGS. 16A and 16B and FIGS. 17A and 17B, it is confirmed that, with the provision of the auxiliary yoke 31, the directions of lines of a magnetic force of the permanent magnet and the distribution of intensities of the lines of the magnetic force change.

It is also confirmed how and to what extent lines of magnetic forces of the first and second permanent magnets 30, 32 are applied between the fixed contacts 21*a* to 24*a* and the movable contacts 86*a*, 86*b*, 87*a*, 87*b* from the results of analysis shown in FIGS. 14A and 14B and FIGS. 15A and 15B.

INDUSTRIAL APPLICABILITY

The present invention is not limited to a DC electromagnetic relay and may be applied to an AC electromagnetic relay.

In this embodiment, the case where the present invention is applied to the electromagnetic relay having four poles has been described. However, the present invention is not limited to such a case, and the present invention may be applied to an electromagnetic relay having at least one pole.

The present invention is not limited to an electromagnetic relay, and may be applied to a switch.

REFERENCE SIGNS LIST

10: base
10*a*: engaging claw portion
11: recessed portion
12: partition wall
13: stepped portion
14: press fitting hole
15*a*, 15*b*, 15*c*, 15*d*: terminal hole
16*a*, 16*b*: terminal hole
17: notched groove
18: recessed portion
19: arc extinguishing space
21 to 24: fixed contact terminal
21*a* to 24*a*: fixed contact
25: coil terminal
25*a*: connecting portion
25*b*: terminal portion
30: first permanent magnet
31: auxiliary yoke
32: second permanent magnet
40: electromagnet block
41: spool
42, 43: flange portion
44: trunk portion
45: through hole
46: insulation rib
47: engaging hole
50: relay clip
51: coil
52: iron core
53: magnetic pole portion
55: yoke
60: movable iron piece
70: spacer
71: recessed portion
72: insulation rib
73: insulation rib
74: movable base
80: movable contact piece
81: movable contact piece
82: large width portion
83: large width portion
84: lining member
85: lining member
86*a*, 86*b*: movable contact
87*a*, 87*b*: movable contact
90: cover
91: gas releasing hole
92: engagement receiving portion
93: position restricting rib
100: arc cut-off member
101: projection
102: rib

103: rib
104: tongue member
110: arc

The invention claimed is:

1. An electromagnetic relay comprising:

a base;

an electromagnet block having a spool in which a through hole opening at a flange portion is formed, the electromagnet block being mounted on an upper surface of the base;

a movable iron piece configured to be rotatable based on excitation and non-excitation of the electromagnet block;

a movable contact piece configured to be rotatable integrally with the movable iron piece;

a movable contact fixed to a free end of the movable contact piece; and a fixed contact fixed to a fixed contact terminal, and disposed so as to be connected with and separable from the movable contact along with rotation of the movable contact piece, wherein an insulating rib is formed in a projecting manner on at least one of an inward facing surface of a spacer integrally formed with the movable iron piece and an outward facing surface of the flange portion such that the insulating rib intercepts a straight line which connects a magnetic pole portion which is one end portion of an iron core which projects from the through hole and the fixed contact or the fixed contact terminal with a shortest distance.

2. The electromagnetic relay according to claim 1, wherein an insulating rib mounted on the inward facing surface of the spacer in a sidewardly projecting manner is disposed in a direction toward the magnetic pole portion from the fixed contact.

3. The electromagnetic relay according to claim 2, wherein an insulating rib mounted on the outward facing surface of the flange portion in a sidewardly projecting manner is disposed in a direction toward the magnetic pole portion from the fixed contact.

4. The electromagnetic relay according to claim 3, wherein the insulating rib mounted on the outward facing surface of the flange portion in a sidewardly projecting manner is disposed such that the insulating rib intercepts a straight line which connects a distal end of the insulating rib mounted on an inward facing surface of the spacer in a sidewardly projecting manner and the magnetic pole portion with a shortest distance.

5. The electromagnetic relay according to claim 2, wherein the insulating rib mounted on the outward facing surface of the flange portion in a sidewardly projecting manner is disposed such that the insulating rib intercepts a straight line which connects a distal end of the insulating rib mounted on an inward facing surface of the spacer in a sidewardly projecting manner and the magnetic pole portion with a shortest distance.

6. The electromagnetic relay according to claim 1, wherein an insulating rib mounted on the outward facing surface of the flange portion in a sidewardly projecting manner is disposed in a direction toward the magnetic pole portion from the fixed contact.

7. The electromagnetic relay according to claim 6, wherein the insulating rib mounted on the outward facing surface of the flange portion in a sidewardly projecting manner is disposed such that the insulating rib intercepts a straight line which connects a distal end of the insulating rib mounted on an inward facing surface of the spacer in a sidewardly projecting manner and the magnetic pole portion with a shortest distance.

8. The electromagnetic relay according to claim 1, wherein the insulating rib mounted on the outward facing surface of the flange portion in a sidewardly projecting manner is disposed such that the insulating rib intercepts a straight line which connects a distal end of the insulating rib mounted on an inward facing surface of the spacer in a sidewardly projecting manner and the magnetic pole portion with a shortest distance.

* * * * *